US006966125B2

(12) United States Patent
Rago et al.

(10) Patent No.: US 6,966,125 B2
(45) Date of Patent: Nov. 22, 2005

(54) AUTOMATIC AIR MOVEMENT FOR HAIR DRYERS

(75) Inventors: Paul S. Rago, Danville, CA (US); David B. Small, San Jose, CA (US)

(73) Assignee: Shoot the Moon Products II, LLC, Pleasanton, CA (US)

( * ) Notice: Subject to any disclaimer, the term of this patent is extended or adjusted under 35 U.S.C. 154(b) by 15 days.

(21) Appl. No.: 10/666,641

(22) Filed: Sep. 18, 2003

(65) Prior Publication Data

US 2005/0072019 A1 Apr. 7, 2005

(51) Int. Cl.[7] ..... A45D 20/00

(52) U.S. Cl. ..... 34/283; 34/96; 34/97; 392/384; 392/385; 132/212; 239/581.1

(58) Field of Search ..... 34/283, 96, 97; 392/379, 380, 383, 384, 385; 132/212; 239/581.1

(56) References Cited

U.S. PATENT DOCUMENTS

| | | | |
|---|---|---|---|
| 1,639,753 | A | 8/1927 | Shelton |
| 2,827,060 | A | 3/1958 | Marty |
| 2,980,340 | A | 4/1961 | McEachern |
| 3,860,174 | A | 1/1975 | Cercone |
| 4,010,902 | A | 3/1977 | Speyer |
| 4,019,260 | A | 4/1977 | Levy et al. |
| 4,114,022 | A | 9/1978 | Braulke, III |
| 4,132,360 | A | 1/1979 | Lee, Jr. |
| 4,232,454 | A | 11/1980 | Springer |
| 4,295,283 | A | 10/1981 | Tomaro |
| 4,562,321 | A | 12/1985 | Bolongeat-Mobleu et al. |
| 4,602,146 | A | 7/1986 | Barnes et al. |
| 4,678,410 | A | 7/1987 | Kullen |
| 4,691,451 | A | 9/1987 | Giorgis |
| 4,716,604 | A | 1/1988 | Watkins |
| 4,732,539 | A | 3/1988 | Shin-Chin |
| 4,827,105 | A | 5/1989 | Brown, Jr. |
| 4,878,620 | A | 11/1989 | Tarleton |
| 4,904,847 | A | 2/1990 | Kosaka et al. |
| 4,934,069 | A | 6/1990 | Kagi |
| 4,936,027 | A | 6/1990 | Tsuji |
| 5,054,211 | A | 10/1991 | Shulman |
| 5,091,630 | A | 2/1992 | Djuric |
| 5,121,463 | A | 6/1992 | Yoshihara |
| 5,157,757 | A | 10/1992 | McDougall |
| 5,161,317 | A | 11/1992 | McDougall |
| 5,195,253 | A | 3/1993 | Poumey et al. |
| 5,317,815 | A | 6/1994 | Hwang |

(Continued)

FOREIGN PATENT DOCUMENTS

| | | |
|---|---|---|
| CA | 1 183 345 | 3/1985 |

*Primary Examiner*—Jiping Lu
(74) *Attorney, Agent, or Firm*—Blakely, Sokoloff, Taylor & Zafman, LLP

(57) ABSTRACT

An oscillating hair dryer nozzle assembly attaches to a hand held electric hair dryer. An oscillating nozzle is pivoted back and forth by forced air generated by an electric motorized fan within the hair dryer. A propeller receives the forced air and rotates a propeller shaft which is coupled to a gear reduction assembly. The gear reduction assembly converts the rotational motion of the propeller shaft into repetitive pivotal movement of the oscillating nozzle. The oscillating nozzle automatically redirects the air flow in a plane. In one embodiment, the nozzle assembly is rotatably attached to the output barrel of a hair dryer body so that the oscillating nozzle can be rotated to pivot and redirect air flow in a different plane.

27 Claims, 10 Drawing Sheets

U.S. PATENT DOCUMENTS

| | | | |
|---|---|---|---|
| 5,333,787 | A | 8/1994 | Smith et al. |
| 5,341,578 | A | 8/1994 | Anderson |
| 5,343,881 | A | 9/1994 | Golan et al. |
| 5,367,739 | A | 11/1994 | Johnson |
| 5,392,528 | A | 2/1995 | McDougall |
| 5,467,540 | A | 11/1995 | Bastien |
| 5,471,763 | A | 12/1995 | McArthur |
| 5,473,824 | A | 12/1995 | Prehodka |
| 5,546,674 | A | 8/1996 | Lange et al. |
| 5,689,896 | A | 11/1997 | Smetana |
| 5,720,107 | A | 2/1998 | Rolf et al. |
| 5,765,292 | A | 6/1998 | Chan |
| 5,839,451 | A | 11/1998 | Dorber et al. |
| 5,841,943 | A | 11/1998 | Nosenchuck |
| 5,876,281 | A | 3/1999 | Hirasawa et al. |
| 5,894,849 | A | 4/1999 | Ehlhardt et al. |
| 6,011,903 | A | 1/2000 | Nosenchuck |
| D429,374 | S | 8/2000 | Muller |
| 6,199,295 | B1 | 3/2001 | Smal et al. |
| 2001/0051042 | A1 | 12/2001 | Ohmura |

FIG. 3B
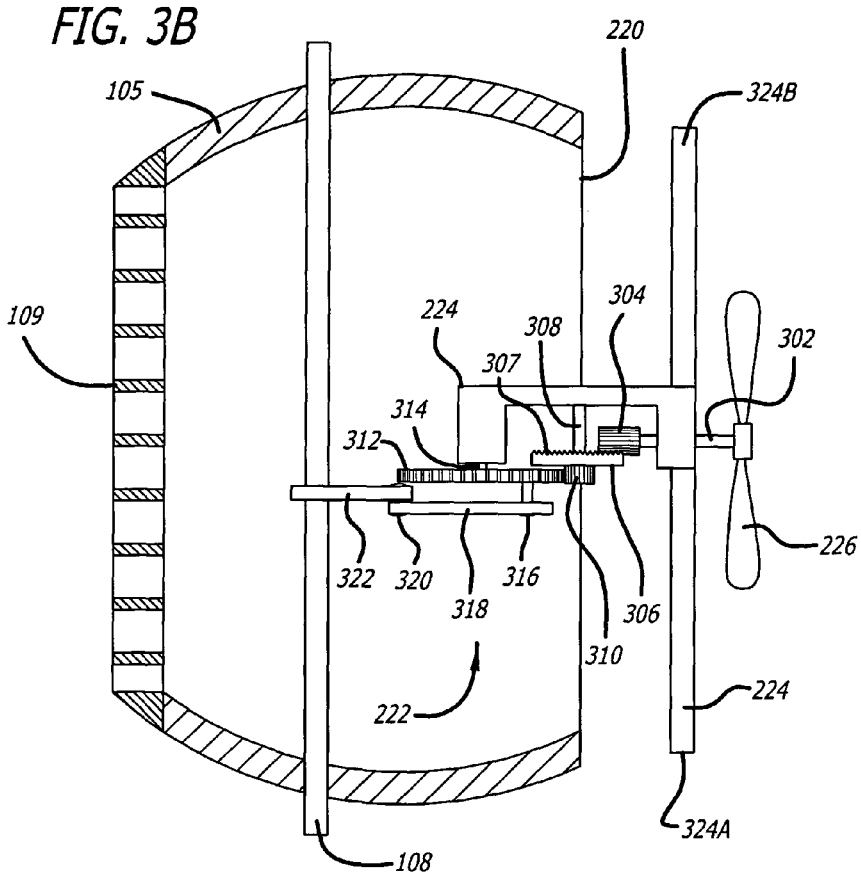
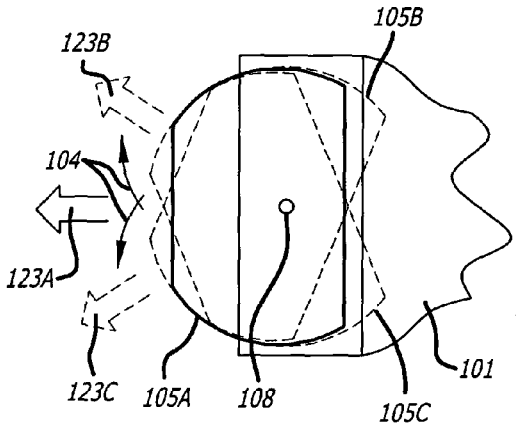
FIG. 4
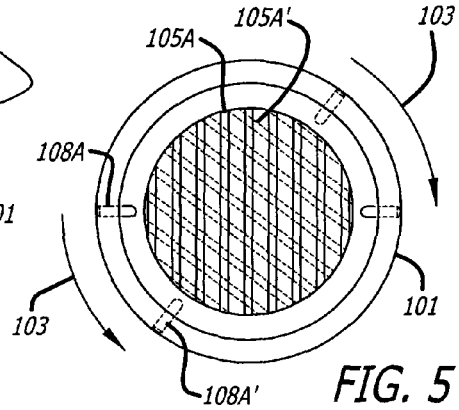
FIG. 5

AUTOMATIC AIR MOVEMENT FOR HAIR DRYERS

FIELD OF THE INVENTION

This invention relates generally to the field of portable hand held hair dryers and more specifically to an oscillating hair dryer nozzle.

BACKGROUND OF THE INVENTION

Portable hand held electric hair dryers are well known. A fan assembly and heater coils located within a typical hair dryer housing act together to cause a powerful stream of hot air to exit the hair dryer. A user points the exit portion of the hair dryer at his or her hair to cause a drying action.

In order to effectively dry a users hair, the hand held portable hair dryer is constantly moved by hand (i.e., manually) so that all of the hair will get dried and further that the air stream does not burn any portion of a users hair or scalp. The hair dryer is held in one hand of a user while the other hand is using a brush or comb to fluff, lift or style the hair.

A number of hair dryer attachments are well known. One well known attachment is a diffuser that helps to diffuse the hot air output from a hair dryer. Diffusers generally spread the air stream into a larger pattern in an attempt to apply the hot air stream to a larger area of hair. This is to reduce the possibility of over heating the hair or scalp and thereby reducing the amount of movement that the operator must apply to the dryer. However, diffusers tend to reduce the hair drying ability of the air stream. Furthermore, diffuser attachments may still cause an uncomfortable burning sensation on the scalp of a user due to the hot air emanating from the hair dryer unless the hair dryer is moved around. Constantly moving the weight of the portable hair dryer may be tiring to users, especially to those unaccustomed to doing so.

Other hair dryer attachments pulse the air stream. These pulsar attachments may restrict air flow and thereby reduce drying efficiency.

BRIEF DESCRIPTION OF THE DRAWINGS

The features of the invention will become apparent from the following detailed description of the invention in which:

FIG. 3B is a magnified cutaway side view illustrating the oscillating nozzle and other components assembled thereto of FIG. 2.

FIG. 4 is a side view illustrating pivot positions of the oscillating nozzle within the nozzle assembly of the hair dryer.

FIG. 5 is a front view illustrating rotational positions of the nozzle assembly coupled to the hair dryer body.

DETAILED DESCRIPTION OF THE INVENTION

Figure 1:
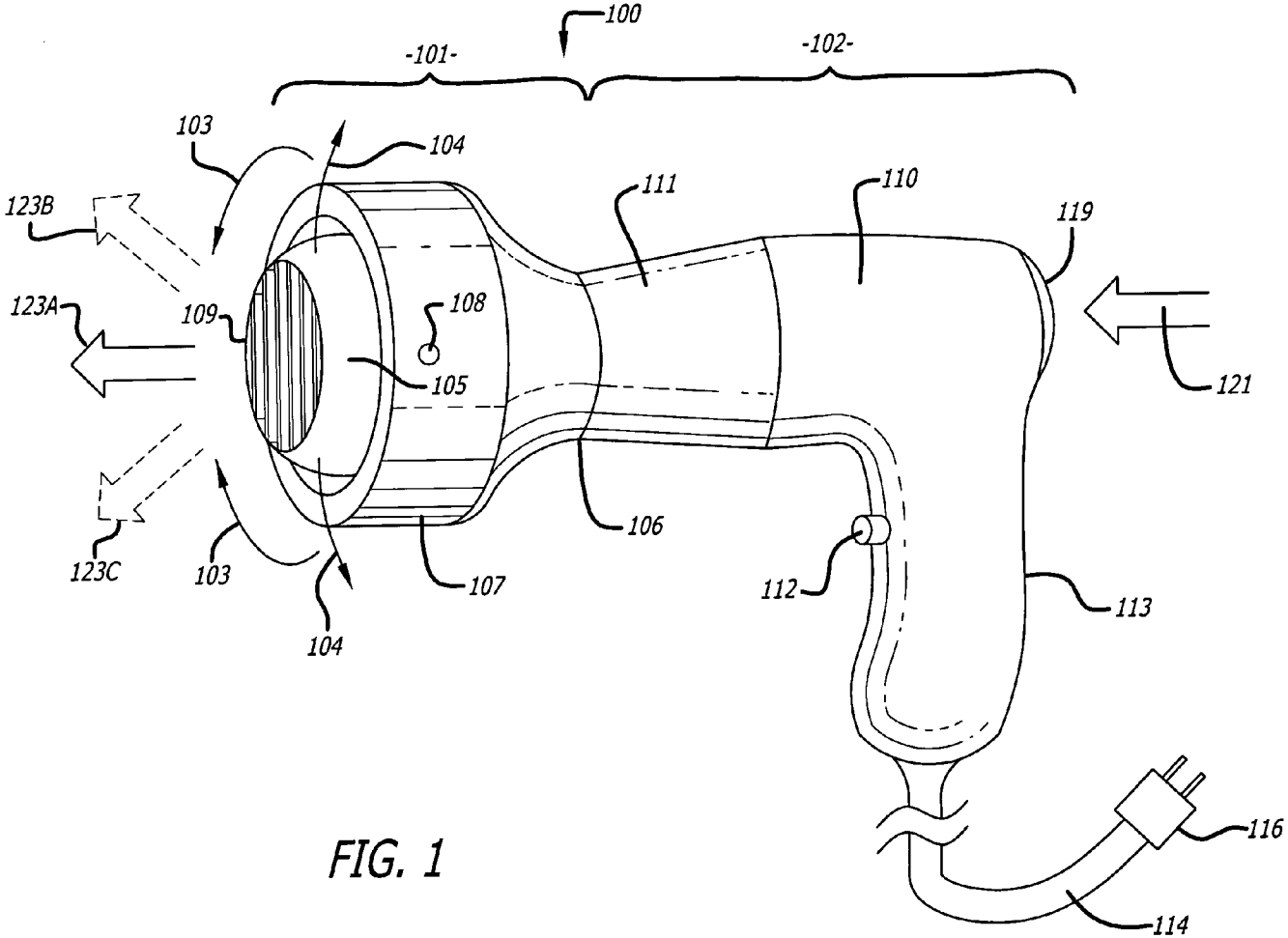
FIG. 1 is a side view of an embodiment of a hair dryer incorporating the invention.

In the following detailed description of the invention, numerous specific details are set forth in order to provide a thorough understanding of the invention. However, it will be obvious to one skilled in the art that the invention may be practiced without these specific details. In other instances well known methods, procedures, components, and elements have not been described in detail so as not to unnecessarily obscure aspects of the invention.

The invention provides a portable hair dryer that can automatically move a continuous stream of collimated hot air over a users hair, emulating the natural motion of an operator when using a typical hand held portable hair dryer. The oscillation of the nozzle can automatically move the air flow in waves back and forth across a users head. In one embodiment, the hot air can be oscillated back and forth in a linear pattern within a plane. The air flow out of the hair dryer is a continuous stream in that it oscillates back and forth without any air flow interruption to make it easier for a user to dry his or her hair. The automatic movement of the air flow is provided by an oscillating hair dryer nozzle which is powered by forced air exiting from the hair dryer. In one embodiment, the oscillating hair dryer nozzle is an integral part of the hair dryer. In another embodiment, the oscillating hair dryer nozzle is part of a hair dryer attachment which may be coupled to the hair dryer in various ways. The hair dryer nozzle may be rotatable with respect to the barrel of the hair dryer to different positions to further provide oscillating air movement in different planes. With the nozzle being rotatable, the linear pattern of hot air flow can be reoriented with respect to the barrel and the pistol grip of the hair dryer. For example, the hot air flow pattern may be reoriented from side to side movement in a first plane to an up and down movement in a second plane perpendicular to the first.

Automatic air flow movement for a hand held hair dryer can be accomplished by generating an air flow within a housing, directing the air flow at a propeller to rotate the propeller and a propeller shaft coupled to the propeller, directing the air flow into a nozzle, converting rotational motion of the propeller shaft into a repetitive pivotal motion of the nozzle, and by oscillating the air flow out from the nozzle by repetitively pivoting the nozzle in response to the rotational motion of the propeller shaft.

In one embodiment of the invention, a hand held hair dryer has automatic air movement. The hand held dryer in this case includes a housing; a fan to generate an air flow in the housing; a propeller with a propeller shaft aligned with the fan to receive the air flow; a nozzle pivotally mounted in the housing; and a plurality of gears between the nozzle and the propeller shaft, the plurality of gears to pivot the nozzle to redirect the air flow out from the hand held hair dryer in response to rotation of the propeller.

In another embodiment of the invention, a hair dryer attachment includes a housing with a first opening to couple to an end of a hair dryer; a propeller aligned with the first opening of the housing to receive air flow from the end of the hair dryer, the propeller coupled to a propeller shaft; a nozzle pivotally mounted in the housing; and a gear stack coupled between the nozzle and the propeller shaft, the gear stack to pivot the nozzle in response to rotation of the propeller.

In yet another embodiment of the invention, a universal nozzle attachment for a hair dryer has an oscillating nozzle to redirect air flow received from the hair dryer; a collar to pivotally support the oscillating nozzle, the oscillating nozzle pivotally mounted to the collar in an opening thereof; a hollow flexible rubber boot having a first opening at a first end to couple to a barrel of the hair dryer and a second opening at a second end to couple to the collar; a bracket coupled to the collar; a propeller aligned in the center of the first opening of the boot, the propeller coupled to a propeller shaft supported by the bracket; and a gear stack supported by the bracket, the gear stack between the oscillating nozzle and the propeller shaft to convert a rotational motion in the propeller shaft into a pivotal motion of the oscillating nozzle.

Referring now to FIG. 1, a side view of a portable hand held electric hair dryer 100 incorporating the invention is illustrated. The portable hand held electric hair dryer 100 includes a nozzle assembly 101 and a hair dryer body 102. As will be discussed further below, the nozzle assembly 101 may be an attachment to the hair dryer body 102 or an integral part thereof. The nozzle assembly 101 may rotate with respect to the hair dryer body 102 as illustrated by arrows 103 in FIG. 1. That is, the nozzle assembly 101 may be rotatably coupled to the hair dryer body 102 at a joint 106.

In one embodiment, the nozzle assembly 101 includes an oscillating nozzle 105, a nozzle housing 107, and a pivot shaft 108 around which the oscillating nozzle 105 can pivot within the nozzle housing 107. Arrows 104 illustrate how the oscillating nozzle 105 can pivot back and forth within the nozzle housing 107 about the pivot shaft 108.

The oscillating nozzle 105 includes an external louvered opening 109 for the air flow to exit from the nozzle assembly 101 and the hair dryer 100 and an internal opening (not shown in FIG. 1, see opening 232 of FIG. 2) for the air flow to enter the nozzle assembly 101 from the hair dryer body 102. The louvers of the external louvered opening 109 are for safety to keep fingers from being injured by any moving parts. The louvers of the external louvered opening 109 need not be in any particular direction on the oscillating nozzle 105. The shape of the oscillating nozzle 105 may be a hollow cylindrical shape or a somewhat hollow spherical shape with openings at opposing ends.

The hair dryer body 102 includes a housing 110 with a barrel 111 and a hand grip 113, a switch 112, and an electrical cord with a plug 116, and an external louvered opening 119 at one end. The switch 112 may have a number of switch settings to provide no air movement (i.e., OFF), slow air movement, medium air movement, and fast air movement in conjunction with heat settings of no heat, low heat, medium heat, and high heat. At the end of the barrel 111 there is a second opening (not shown in FIG. 1, see opening 242 in FIG. 2) in the housing 110 to allow air flow from the hair dryer body 102 into the nozzle assembly 101.

Figure 2:
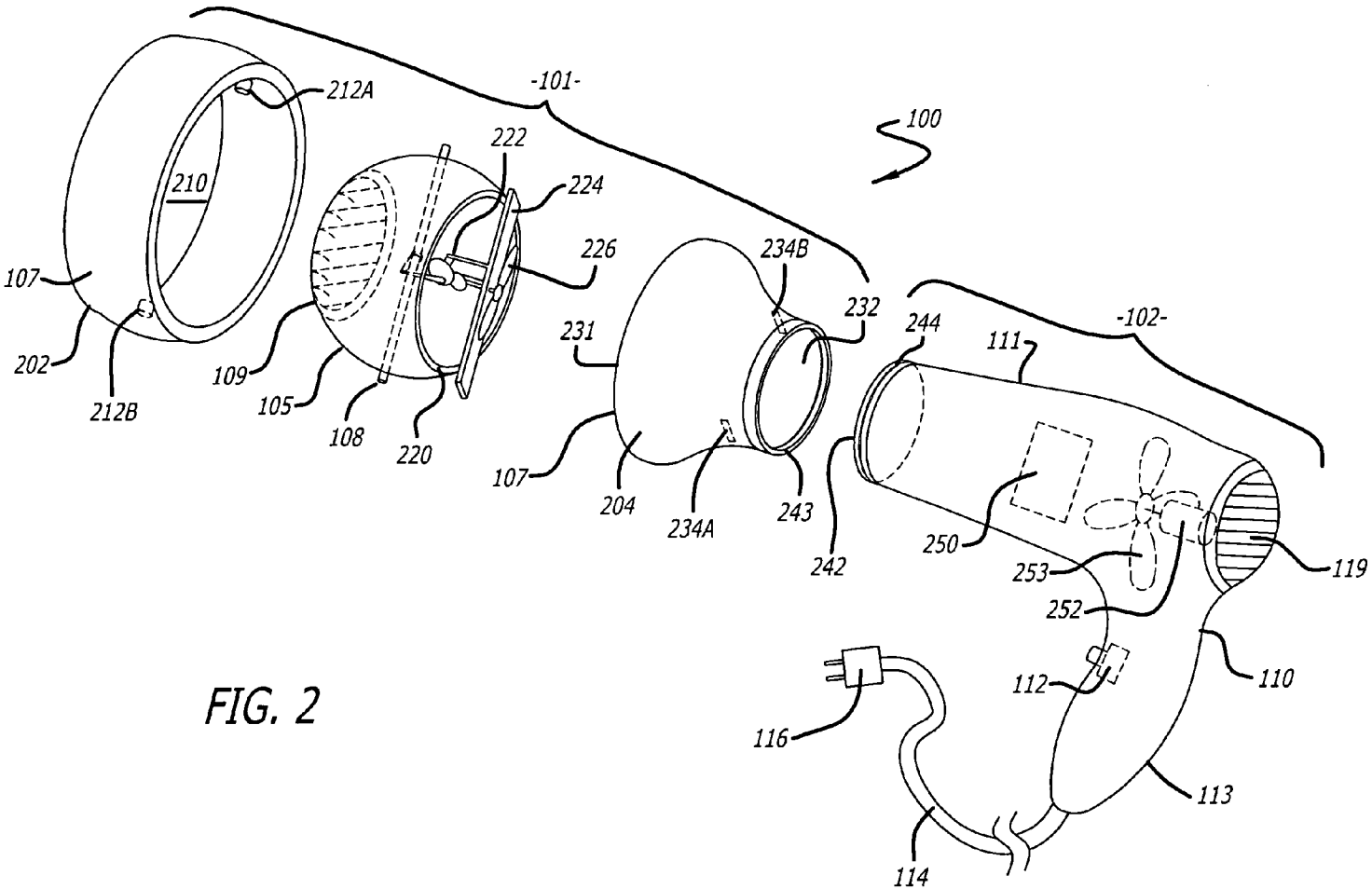
FIG. 2 is an exploded perspective view of the hair dryer of FIG. 1 incorporating the invention.

In operation, air is drawn into the hair dryer 100 through the opening 119 as shown by arrow 121 by a motorized fan (not shown in FIG. 1, see motorized fan 252 in FIG. 2). Within the hair dryer 100, air under the force of the motorized fan within the housing 110 exits the hair dryer body 102 and enters the nozzle assembly 101, near the joint 106 in one embodiment. The air then exits the hair dryer 100 through the opening 109 as shown by arrows 123A–123C. That is, the hair dryer 100 draws air in from the rear end and blows air out of its front end.

The air flow within the hair dryer 100 from the fan turns a propeller (not shown in FIG. 1, see propeller 266 in FIG. 2) which is coupled to a gear stack. With the gear stack coupled to the oscillating nozzle 105, the rotation of the propeller may be converted by to a periodic swing or oscillation in the oscillating nozzle 105. The power for the oscillating action of the nozzle 105 is derived from the forced air provided by the hair dryer body 102 and does not need another source of power. The periodic swing can be repeated as the propeller continues to spin in an oscillating or reciprocating motion. The movement of the oscillating nozzle 105 generates air movement back and forth which can be directed at the hair on ones head.

With the oscillating nozzle 105 oscillating in the direction shown, the air flow exiting the hair dryer is redirected between positions 123A–123C. The air flow within the hair dryer body 102 may be heated by an electric heater (not shown in FIG. 1, see electric heater 250 of FIG. 2) so it is hot when it exits.

Referring now to FIG. 2, an exploded view of the hair dryer 100 is illustrated with the nozzle assembly 101 separated from the hair dryer body 102 and partially disassembled. The nozzle assembly 101 includes the oscillating nozzle 105 with the pivot shaft 108, a gear stack 222, a gear bracket 224, and a propeller 226. The oscillating nozzle 105 has a louvered opening 109 at one end and an air intake opening 220 at an opposite end. The gear bracket 224 extends out of the oscillating nozzle 105 through the air intake opening 220. The propeller 226 rotates outside of the air intake opening 220 of the oscillating nozzle 105. While the oscillating nozzle 105 moves with respect to the housing 107, the gear bracket 224 is fixed in place. The air intake opening 220 is properly positioned and of sufficient size to allow the oscillating nozzle 105 to pivot without binding against the gear bracket 224 or the propeller 226.

As discussed previously, the gear stack 222 converts the rotational movement of the propeller 226 and a propeller shaft into a periodic swing or oscillation in the oscillating nozzle 105. To do so, the gear stack 222 provides gear reduction to reduce the number of rotations of the propeller 226 down to a lower frequency. The gear stack 222 may include a transmission in one embodiment to control the oscillation speed (e.g., Off, slow, medium, high) and/or frequency (i.e., the number of oscillation per second) by changing the amount of gear reduction and whether the motion of the propeller is coupled to the nozzle or not and by how much.

The nozzle assembly 101 may further include the nozzle housing 107 with a retaining collar 202 and an intake sleeve 204 in one embodiment. As discussed further below, the nozzle assembly may be an integral part of the housing 110 of the hair dryer body 102.

The retaining collar 202 has an opening 210 to receive the oscillating nozzle 105 and a pair of spacer bushings 212A–212B each of which have an opening to receive an end of the pivot shaft 108. The spacer bushings 212A–212B allow the oscillating nozzle to pivot within the retaining collar 202. The retaining collar 202 pivotally supports the oscillating nozzle 105 through the ends of the pivot shaft 108 being coupled in the pair of spacer bushings 212A–21B. The opening 210 in the retaining collar 202 slides over the intake sleeve 204 as the gear bracket 224 is mounted into a pair of mounting bushings 234A–234B of the intake sleeve 204.

The intake sleeve 204 includes a first opening 231 to receive the oscillating nozzle 105. The intake sleeve 204 further includes a second opening 232 to couple to the barrel 111 of the hair dryer body 102 and to receive air flow out from the opening 242. The intake sleeve 204 rotatably couples the nozzle assembly 101 to the end of hair dryer body 102 at the joint 106. The intake sleeve 204 further includes the pair of mounting bushings 234A–234B to mate with a pair of arms of the gear bracket 224. With the arms of the gear bracket 224 mounted into the mounting bushings 234A–234B, the gear stack 222 is fixed in place with respect to the nozzle 105 and the housing 107.

The intake sleeve 204 may further include a circular groove 243 to mate with a circular ring 244 of the hair dryer body 102. The circular groove 243 and circular ring 244 keep the nozzle assembly 101 rotatably coupled to the hair dryer body 102. That is, it is easy to rotate the nozzle assembly 101 but difficult to detach it from the hair dryer body 102 in one embodiment.

In another embodiment, the intake sleeve 204 has a pair of flanges located around the edge of opening 232 and the hair dryer body 102 has a recessed ring or circular groove instead of a circular ring 244. In this case, the pair of flanges of the intake sleeve 204 snap into the recessed ring or circular groove of the hair dryer body 102 to form a rotatable junction between the nozzle assembly 101 and the hair dryer body 102. Other methods of joining the nozzle assembly 101 to a hair dryer body may be used, at least one of which is discussed below.

Figure 8:
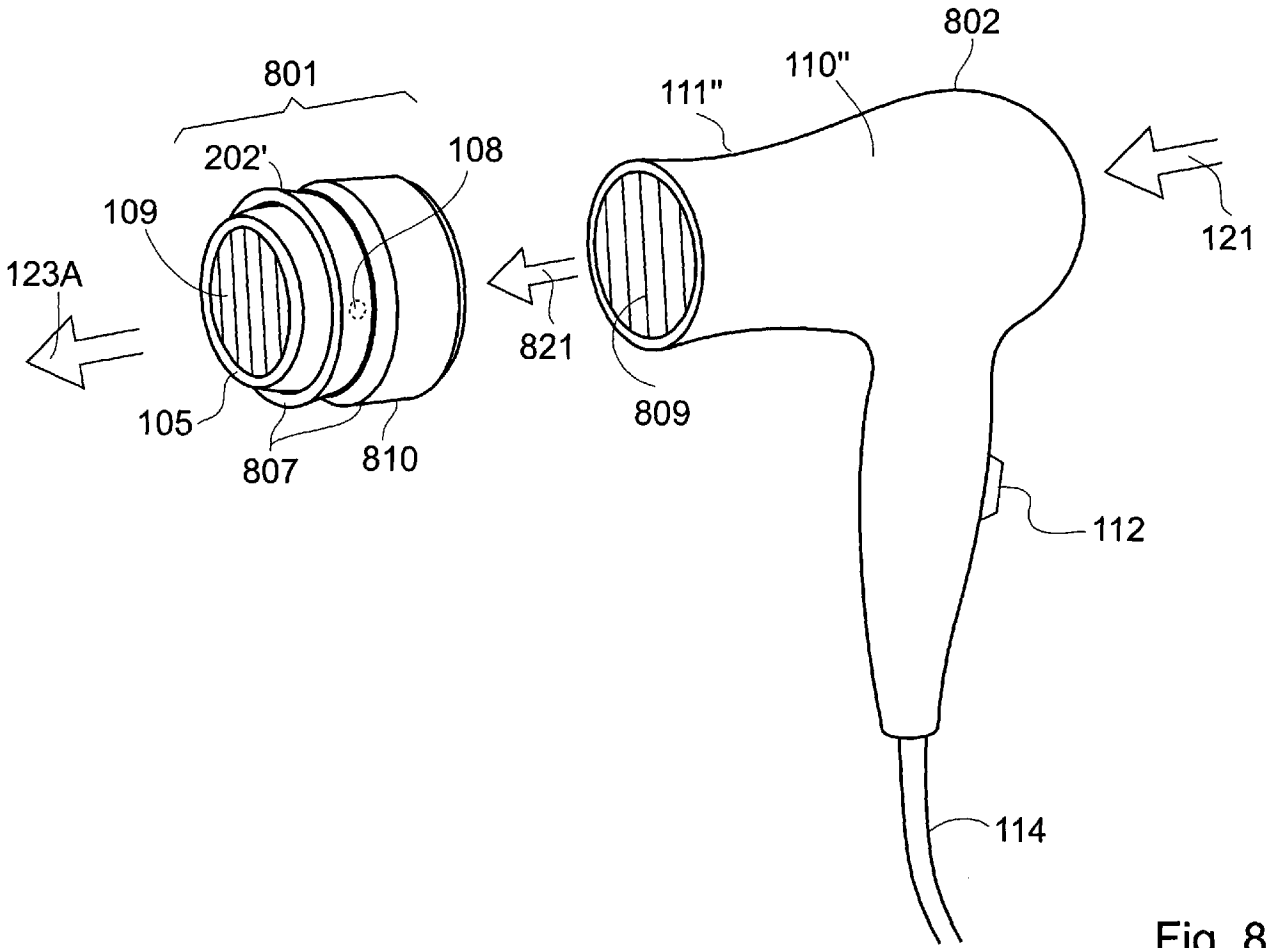
FIG. 8 is a perspective view of a universal nozzle attachment incorporating the invention detached from a standard hair dryer.

The shape of the intake sleeve 204 may be a funnel shape as illustrated in FIGS. 1–5 to expand outward to a larger oscillating nozzle 105. Alternatively, the shape of the intake sleeve 204 may be a hollow cylindrical shape, such as illustrated in FIG. 8, to more closely match the size of the oscillating nozzle 105 and the barrel ill of the hair dryer body 102. Alternatively, the intake sleeve 204 may be forgone and the gear stack 222 may be held in place by coupling the gear bracket 224 to the barrel ill of the hair dryer body 102 in a different manner. In another embodiment, a louver (not shown) may be placed within the intake sleeve 204 near the second opening 232 in order to keep fingers from damaging the propeller 226 when the nozzle assembly is detached from the hair dryer body 102.

Within the housing 110 of the hair dryer body 102, a motorized fan 252, an electric heater 250 and the electrical switch 112 are mounted. The motorized fan 252 includes fan blades 253 to draw air into the housing 110, push the air past the electric heater 250 and into the nozzle assembly 101. The motorized fan 252 electrically couples to the electrical switch 112 for control of fan settings. The electric heater 250 heats up the air flowing through the housing 110 and into the nozzle assembly 101. The electric heater 250 electrically couples to the electrical switch 112 for control of heat settings. A button or knob of the electrical switch 112 extends through the housing 110 for use by a user. In another embodiment, the electrical switch 112 may be more than one electrical switch for separate control of the motorized fan 252 and the electric heater 250. The housing 110 may further include the circular ring 244 so that the nozzle assembly 101 is rotatably coupled to the hair dryer body 102 in one embodiment.

In response to the motorized fan 252 being switched on, air is drawn in through the louvered opening 119 and forced out through the opening 242 in the hair dryer body 102. With the nozzle assembly 101 coupled to the hair dryer body 102, the forced air emanating from the opening 242 travels through the intake sleeve 204 and causes the propeller 226 to rotate and spin a propeller shaft. The gear stack 222 coupled between the propeller shaft and the oscillating nozzle 105, provides gear reduction and causes the oscillating nozzle 105 to oscillate back and forth on pivot points where the ends of the pivot shaft 108 pivotally couple to the spacer bushings 212A–212B. Past the propeller 226, the forced air enters the oscillating nozzle 105 and exits out from the hair dryer 100 through the louvered opening 109 of the oscillating nozzle 105. With the oscillating nozzle 105 moving back and forth, the air exiting through the louvered opening 109 can be automatically redirected back and forth in a repetitive fashion. In which case, the oscillating nozzle 105 can avoid a user from having to continuously wave a hair dryer back and forth to dry hair. If the electric heater 250 is turned on, the air exiting from the oscillating nozzle 105 through louvered opening 109 may be heated.

Figure 3A:
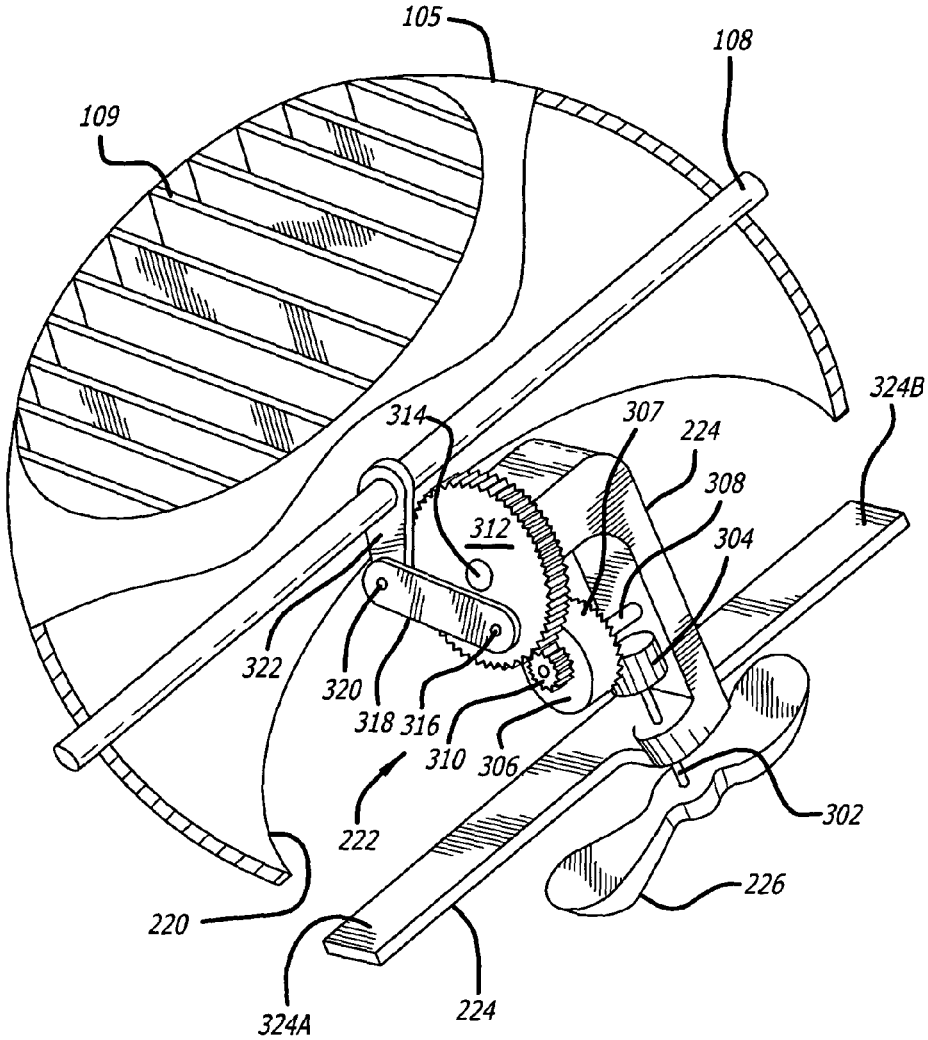
FIG. 3A is a magnified cutaway perspective view illustrating the oscillating nozzle and other components assembled thereto of FIG. 2.

Reference is now made to FIGS. 3A and 3B. FIG. 3A is a magnified cutaway perspective view of the oscillating nozzle 105 to better illustrate how the pivot shaft 108, the gear stack 222, the gear bracket 224, and the propeller 226 are assembled together. FIG. 3B is a magnified cutaway side view of the oscillating nozzle 105, the pivot shaft 108, the gear stack 222, the gear bracket 224, and the propeller 226 assembled together.

The pivot shaft 108 extends through the hollow center and the walls of the oscillating nozzle 105 so that the ends of the pivot shaft protrude through the exterior portion of the oscillating nozzle 105. The pivot shaft 108 is fixedly coupled to the oscillating nozzle 105 near its protruding ends. The ends of the pivot shaft 108 interface with the spacer bushings 212A–212B located on the inside wall of the retaining collar 202.

The gear bracket 224 supports the gear stack 222 and allows the rotating motion of the propeller 226 to be converted into an oscillating motion in the pivot shaft 108 and the oscillating nozzle 105. The pivot shaft 108 is rigidly coupled to the oscillating nozzle 105 to directly couple the oscillating motion thereto. The gear bracket 224 further supports the propeller in alignment with the intake opening 232 of the nozzle housing 107.

The propeller 226 is coupled to one end of a propeller shaft 302. The propeller shaft 302 extends through an opening in the gear bracket 224 and couples to a pinion gear 304 of the gear stack 222 at a second end. The gear bracket 224 rotatably supports the propeller shaft 302 and the propeller 226. The gear bracket 224 further holds the propeller shaft 302 in a rotational position so that the pinion gear 304 is meshed with the teeth of another gear of the gear stack 222.

The gear stack 222 includes the pinion gear 304 coupled to the propeller shaft 302, a crown gear 306, a small spur gear 310, and a large spur gear 312. The pinion gear 304 meshes with the teeth 307 on a front side of a crown gear 306 and may be rotatably coupled to the gear bracket 224 by way of a gear shaft 308. A small spur gear 310 is coupled to a backside of the crown gear 306. A large spur gear 312 meshes with the small spur gear 310. The large spur gear 312 may be rotatably coupled to the gear bracket 224 by means of a gear shaft 314. The large spur gear 312 includes a crank pin 316. The large spur gear 312 may also be referred to as a crank gear or a final drive gear. The gears in the gear stack transfer energy from one to another so that rotational movement of the propeller due to the flow of air generates an oscillating movement in the nozzle 105.

The gears of the gear stack 222 can be interchanged with other types of gears to accomplish the same goal. For example, the pinion gear 304 may be a beveled gear and the crown gear 306 may include a beveled gear to mate with the pinion gear 304. In another embodiment, the gears can be substituted for a worm gear drive to reduce parts count and lower the costs of the hairdryer, for example.

To convert rotational motion into linear motion, the gear stack further includes a linkage arm 318 and a drive arm 322. The drive arm 322 rigidly couples to the pivot shaft 108 at one end and rotatably couples to the linkage arm at the opposite end. That is, at one end the drive arm 322 is attached to the pivot shaft 108 so that they pivot together. The drive arm 322 includes a linkage pin 320 to rotatably couple to an opening in an end of the linkage arm 318. That is, the drive arm 322 and the linkage arm 318 are rotatably pinned together at one end by the linkage pin 320. The linkage arm 318 includes an opening at an opposite end to rotatably couple to the crank pin 316 of the large spur gear 312.

The crank pin 316 is offset from the center of the gear 312 so that the linkage arm 318 can translate the rotational motion in the gear into a repetitive linear motion of the linkage arm 318, back and forth. The drive arm 322 translates the repetitive linear motion of the linkage arm 318 into a repetitive pivoting motion in the pivot shaft 108 and the oscillating nozzle 105.

The gear bracket includes a pair of mounting arms 324A–324B to couple to the mounting bushings 234A–234B, respectively. As illustrated, the gear bracket 224 extends out beyond the opening 220 so that the pair of mounting arms 324A–324B can couple to the mounting bushings 234A–234B.

Referring now to FIG. 4, a cutaway view of the nozzle assembly 102 is illustrated to show a center position 105A of the oscillating nozzle 105 and positions 105B and 105C to show how it pivots about the pivot shaft 108. At the center position 105A, the oscillating nozzle 105 provides air flow in the direction of arrow 123A. At position 105B, the oscillating nozzle 105 provides air flow in the direction of arrow 123B. Position 105B may be one end of the oscillating motion of the nozzle 105. At position 105C, the oscillating nozzle 105 provides air flow in the direction of arrow 123C. Position 105C may be another end of the oscillating motion of the nozzle 105.

Referring now to FIG. 5, a front view of the nozzle assembly 101 is illustrated to show how it may rotate about the barrel 111 of the hair dryer body 102. The nozzle assembly 101 can rotate around the joint 106 so that a user can set the desired angle of the nozzle 105 with respect to a user's arm and hand location. In position 105A, the oscillating nozzle 105 pivots about position 108A of the pivot shaft 108 and provides air flow from left to right with respect to the grip 113, for example. When rotated to position 105A', the oscillating nozzle 105 pivots about position 108A' of the pivot shaft 108 and provides air flow on a diagonal with respect to the grip 113, for example.

Figure 6:
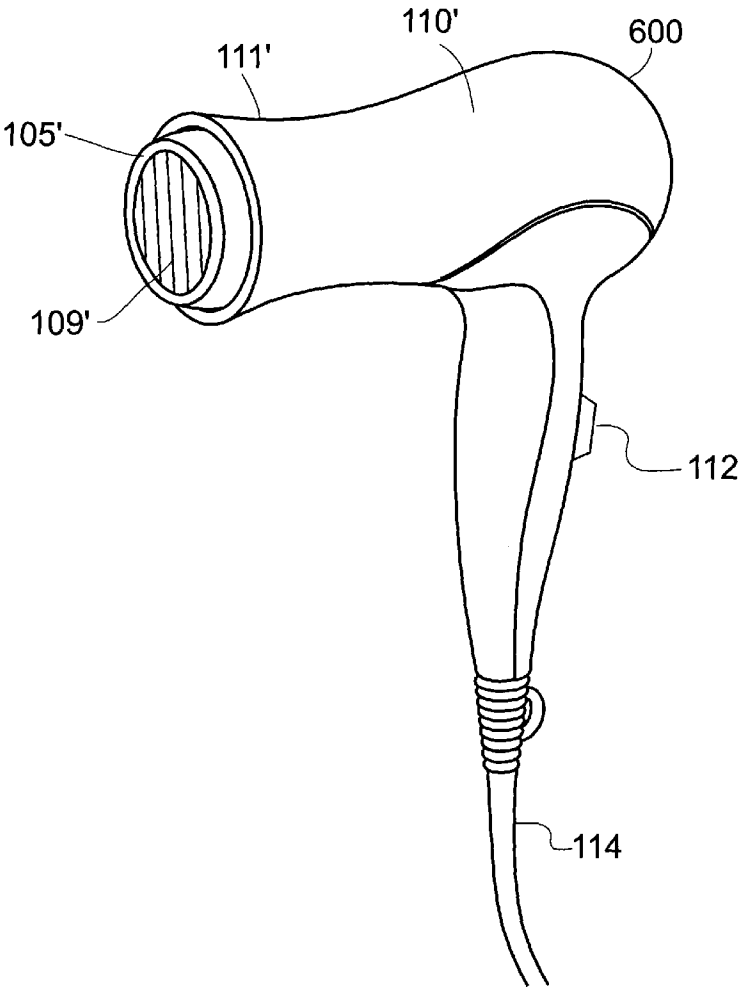
FIG. 6 is a perspective view of an alternate embodiment of a hair dryer incorporating the invention.

Referring now to FIG. 6, a perspective view of an alternate embodiment of a portable hand held electric hair dryer 600 incorporating the invention is illustrated. The hair dryer 600 includes some of the elements of the nozzle assembly 101 and the hair dryer body 102 previously described as in integral part of the hair dryer body. In particular the hair dryer 600 includes the oscillating nozzle 105' as illustrated in FIG. 6. The nozzle housing of the nozzle assembly is not used in the embodiment of the hair dryer 600 as the oscillating nozzle 105' is assembled into the housing 110' of the hair dryer 600. While the oscillating nozzle 105' can repeatedly pivot in response to the air flow within the hair dryer, it is not free to spin or rotate about the barrel 111' of the hair dryer 600. That is, the movement of the oscillating nozzle 105' and its air flow are limited to a single plane.

Figure 7:
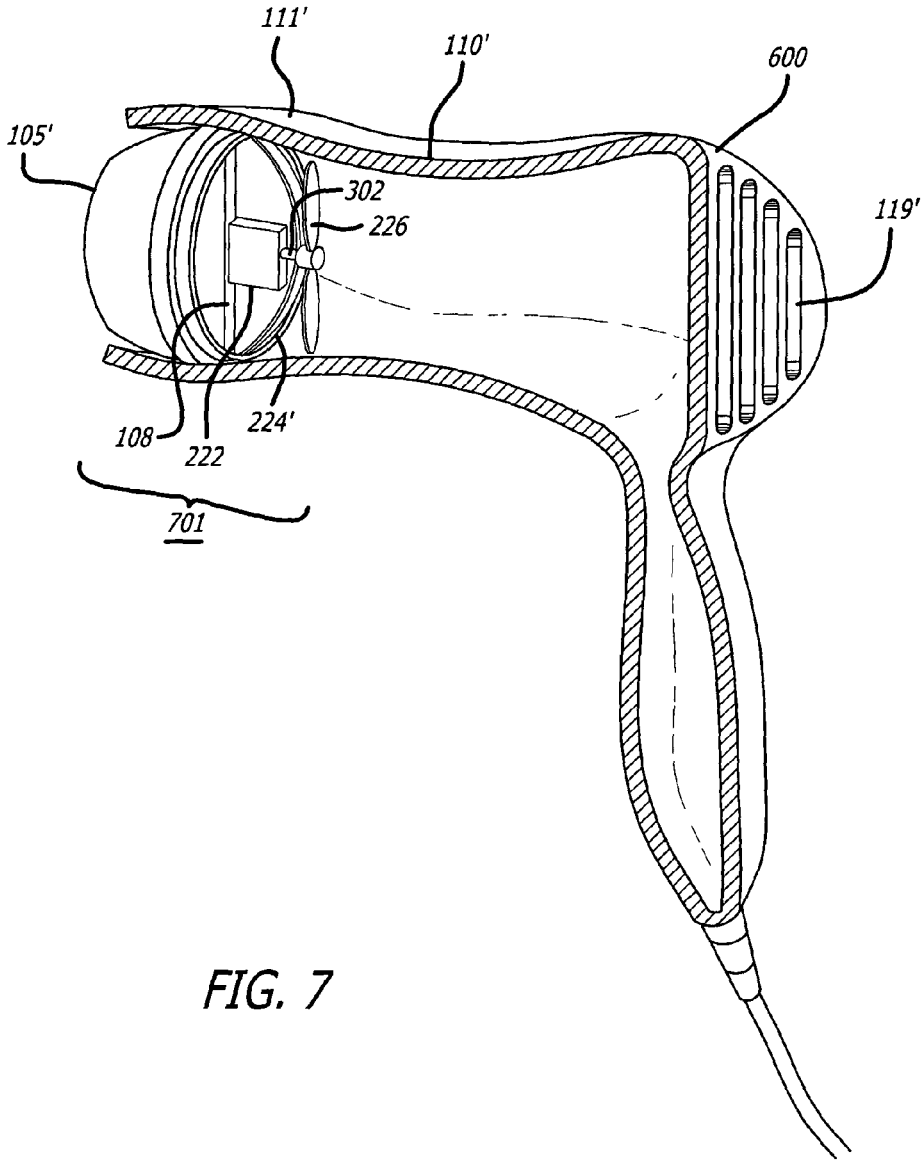
FIG. 7 is a cutaway side view illustrating the nozzle assembly mounted in the housing of the hair dryer of FIG. 6.

Referring now to FIG. 7, a cutaway side view illustrating the nozzle assembly 701 integrated into the housing 110' of the hair dryer 600 is illustrated. The heater 250, motorized fan 252 and switch 112 are not shown in FIG. 7 to avoid obscuring elements of the current embodiment. The nozzle assembly 701 includes an oscillating nozzle 105', a pivot shaft 108, a gear stack 222, a gear bracket 224', and a propeller 226 coupled to a rotatable propeller shaft 302. The gear bracket 224' may be shaped to support the gear stack 222 within the housing 110'. The ends of the pivot shaft 108 are coupled into spacer bushings (not shown in FIG. 7) of an inner surface of the housing 110'. The housing 110' includes a louvered opening 119' so that the motorized fan (not shown in FIG. 7) may draw in air into the housing 110'. The electric heater 250 may be mounted between the motorized fan 252 and the nozzle assembly 701 to heat the air before it is redirected in the oscillating motion by the oscillating nozzle 105'.

The oscillating nozzle 105' is shaped and sized to conform to the interior of barrel 111' of the housing 110' in order to provide pivotable movement therein about the pivot shaft 108. The exterior portions of the gear bracket 224' may be shaped and sized to conform to the interior of barrel 111' of the housing 110' in order to hold the gear bracket in a rigid fixed position thereto.

As discussed previously, the gear stack 222 converts the rotational motion of the propeller shaft into a pivotal motion of the pivot shaft 108 and the oscillating nozzle 105'.

Referring now to FIG. 8, a perspective view of a universal nozzle attachment 801 incorporating the invention detached from a standard hand held hair dryer 802 is illustrated. The standard hand held hair dryer 802 has elements similar to those of the hair dryer body 102 but for the lack of a circular ring 244 or other mechanism to mate with a circular groove or other mounting mechanism of the nozzle assembly 101. The exterior surface of the barrel 111" of the standard hand held hair dryer 802 can be considered to be smooth without recesses, grooves, bumps, or rings. The standard hair dryer 802 further includes a louvered opening 809 that is affixed to the end of the barrel 111". Typically, the louvered opening 809 does not move in response to the air flow 821 within and exiting out from the hair dryer.

The universal nozzle attachment 801 includes a number of similar elements of the nozzle assembly 101 which were previously described including the oscillating nozzle 105, the pivot shaft 108, the louvered opening 109, the gear stack 222, the gear bracket 224, and the propeller 226 with the propeller shaft 302. The universal nozzle attachment 801 further includes a nozzle housing including a retaining collar 202' and a flexible hollow cylindrical rubber boot 810.

The flexible rubber boot 810 of the universal nozzle attachment 801 can be fitted over a wide variety of barrels 111' of standard hand held hair dryers 802. The rubber boot is flexible so that it can match the various shapes of barrels of hair dryers and form a seal. In this manner, the universal nozzle attachment 801 can be attached to a wide variety of standard off the shelf hand held hair dryers.

The universal nozzle attachment 801 functions similarly to the nozzle assembly 101 in that the air flow can be redirected to oscillate back and forth within a plane. The universal nozzle attachment 801 can also be rotated about the barrel 111" to change the orientation of the plane of airflow oscillation, similar to the nozzle assembly 101. Alternatively, the universal nozzle attachment 801 can be pushed onto the barrel 111" with the desired orientation of the plane of airflow oscillation.

Figure 9:
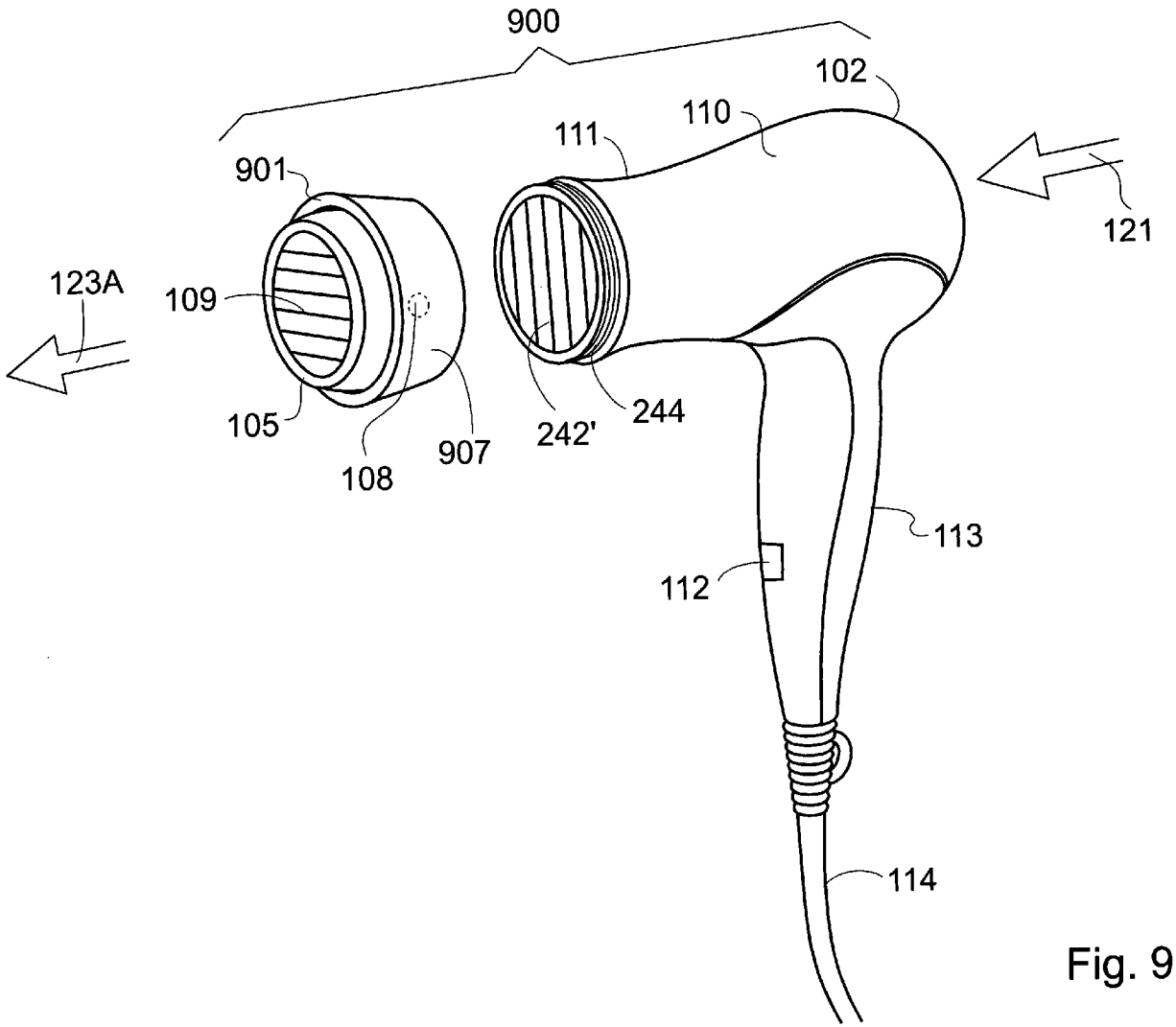
FIG. 9 is a perspective view of an alternate embodiment of a hair dryer incorporating the invention.

Referring now to FIG. 9, a perspective view of an alternate embodiment of an electric hand held hair dryer 900 incorporating the invention is illustrated. The hand held hair dryer 900 includes the hair dryer body 102 and a nozzle assembly 901 with the oscillating nozzle 105. The hair dryer body 102 and its elements were previously shown and described in detail. Note that the opening 242 in the hair dryer body 102 may be a louvered opening 242' as illustrated in FIG. 9.

The nozzle assembly 901 includes a number of similar elements of the nozzle assembly 101 which were previously described including the oscillating nozzle 105, the pivot shaft 108, the louvered opening 109, the gear stack 222, the gear bracket 224, and the propeller 226 with the propeller shaft 302. However, the intake sleeve 204 of the nozzle assembly 101 is not included in the nozzle assembly 901.

The nozzle assembly 901 functions similarly to the nozzle assembly 101 in that the air flow can be redirected to oscillate back and forth within a plane. The nozzle assembly 901 can also be rotated about the barrel 111 to change the orientation of the plane of airflow oscillation, similar to the nozzle assembly 101.

The housing 907 includes elements of the retaining collar 202 but is a longer or wider retaining collar to couple to the barrel 111, as the intake sleeve 204 of the nozzle assembly 101 is forgone. The housing 907 includes the circular groove 243 from the intake sleeve 204 to mate with the circular ring 244 of the hair dryer body 102 without the intake sleeve 204. Alternatively, a pair of flanges located around the edge of housing 907 may be used to mate with recessed ring or circular groove in the hair dryer body 102. In this case, the pair of flanges snap into the recessed ring or circular groove of the hair dryer body 102 to form a rotatable junction between the nozzle assembly 901 and the hair dryer body 102. Other methods of joining the nozzle assembly 901 to the hair dryer body 102 may be used.

Figure 10B:
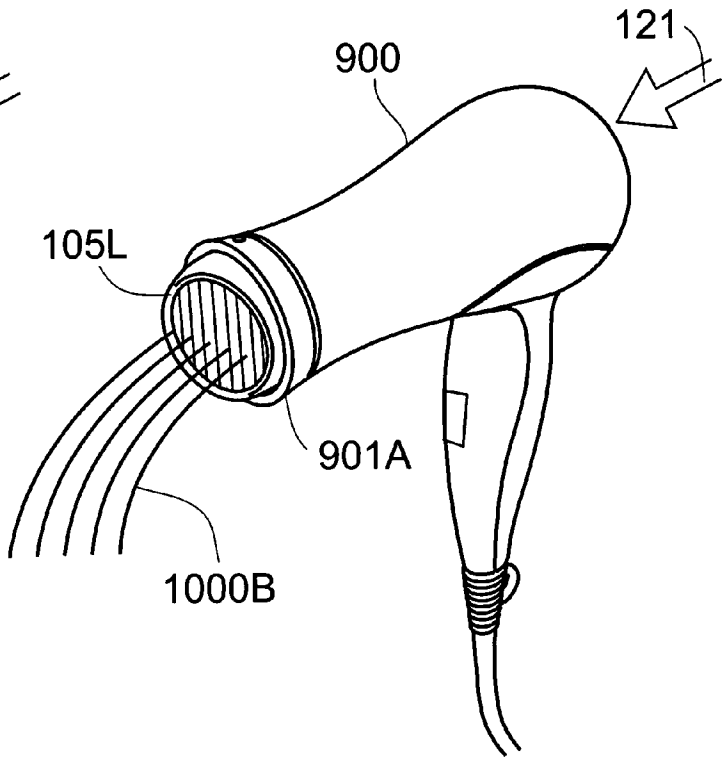
FIGS. 10A–10B are perspective views of the alternate embodiment of FIG. 9 illustrating the planar motion of the oscillating nozzle back and forth in one plane.
Figure 10A:
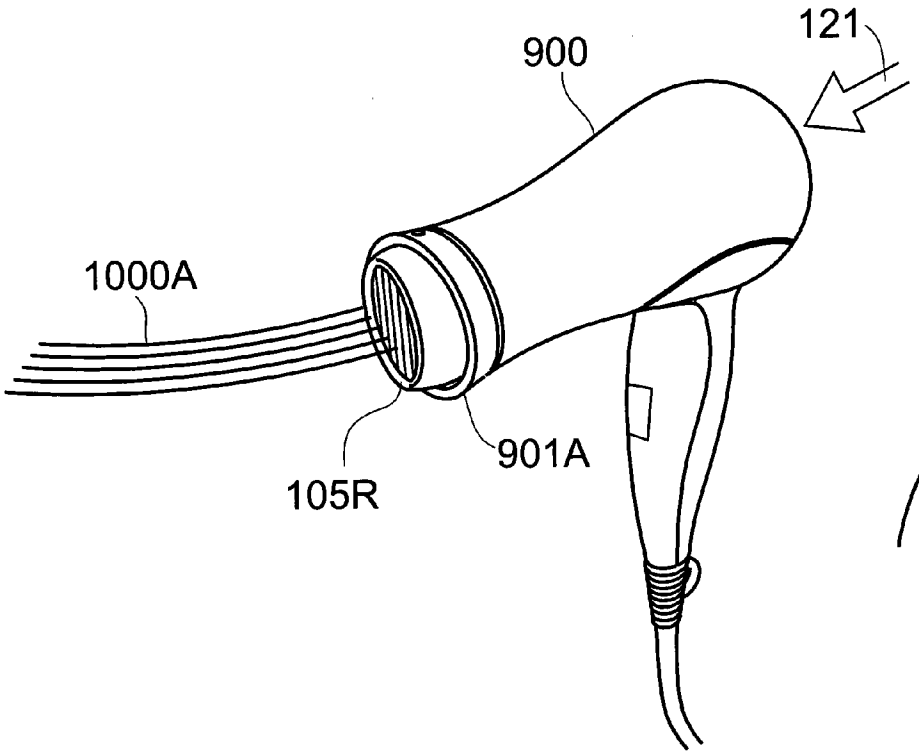

Referring now to FIGS. 10A–10B, perspective views of the assembled hair dryer 900 of FIG. 9 illustrate the planar motion of the oscillating nozzle 105 back and forth in a first plane. In FIGS. 10A–10B, the nozzle assembly 901 is in a first position 901A. In FIG. 10A, the oscillating nozzle 105 is pivoted to a right position 105R to generate air flow in the direction 1000A. In FIG. 10B, the oscillating nozzle 105 is pivoted to a left position 105L to generate air flow in the direction 1000B in the same plane as the air flow in direction 1000A.

Figure 11B:
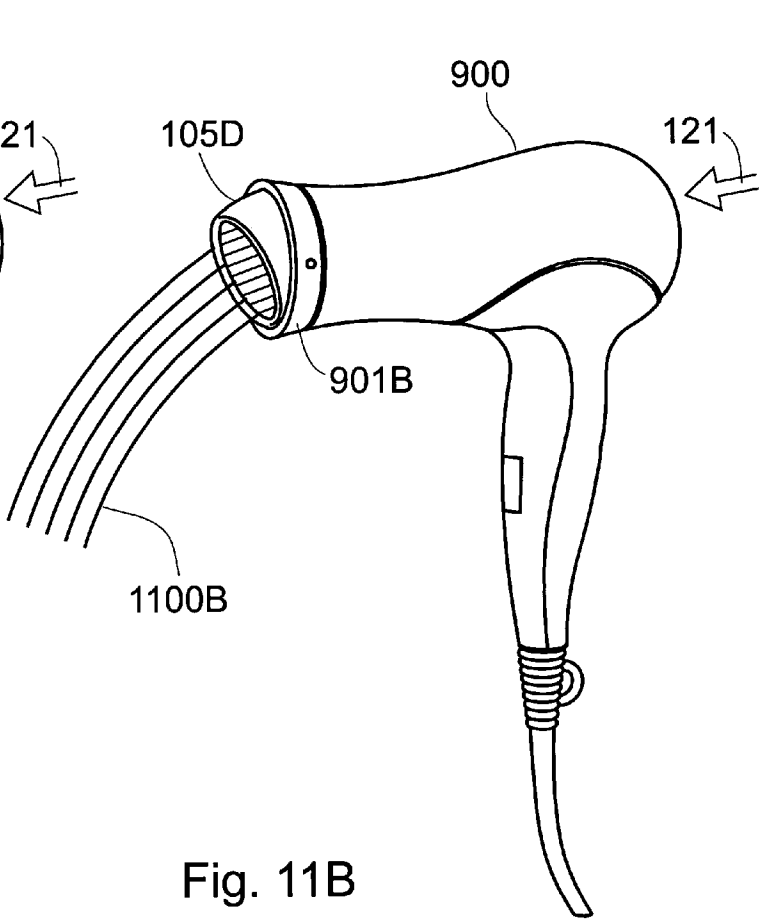
FIGS. 11A–11B are perspective views of the alternate embodiment of FIG. 9 illustrating the planar motion of the oscillating nozzle back and forth in another plane.
Figure 11A:
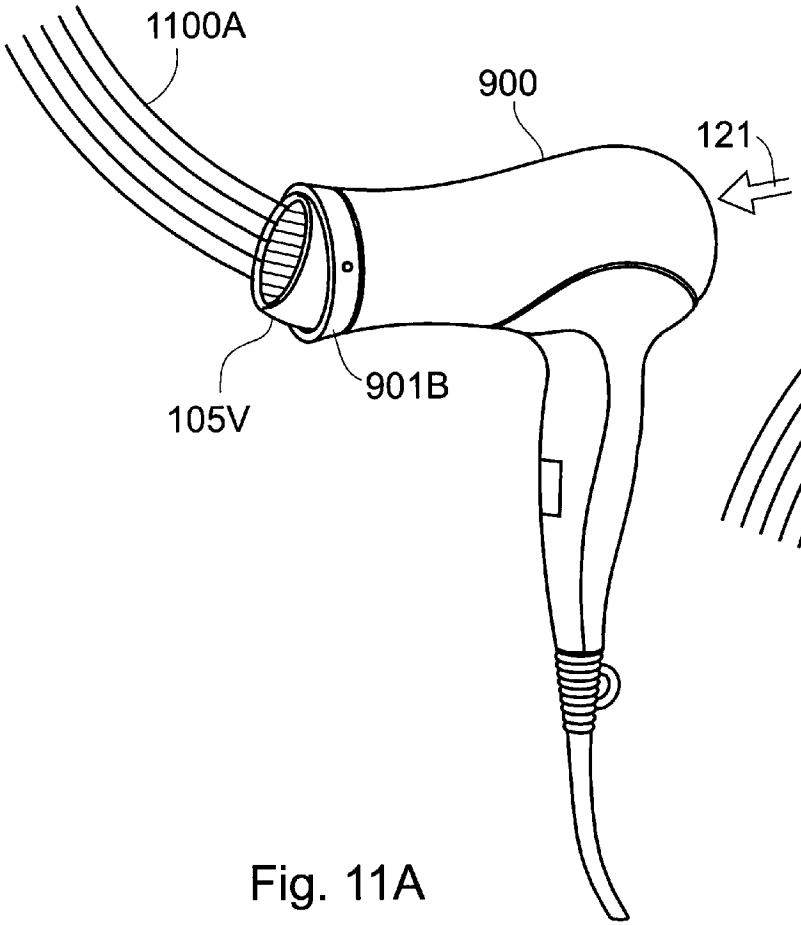

Referring now to FIGS. 11A–11B, perspective views of the assembled hair dryer of FIG. 9 illustrate the planar motion of the oscillating nozzle 105 back and forth in a second plane differing from the first. In FIGS. 11A–11B, the nozzle assembly 901 is in a second position 901B. In FIG. 11A, the oscillating nozzle 105 is pivoted to an up position 105U to generate air flow in the direction 1100A. In FIG. 11B, the oscillating nozzle 105 is pivoted to a down position 105D to generate air flow in the direction 1100B in the same plane as the air flow in direction 1100A.

The automatic air movement provided by the invention can fluff hair as it dries. The automatic oscillation of the nozzle increases the air movement of heated air through the hair to dry the hair faster and more efficiently. Manual movement of the hair dryer is unnecessary to achieve the oscillating air movement provided by the invention.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art. Rather, the claimed invention should be construed according to the claims that follow below.

What is claimed is:

1. A hand held hair dryer with automatic air movement, the hand held dryer comprising:

a housing;

a fan to generate an air flow in the housing;

a propeller with a propeller shaft aligned with the fan to receive the air flow;

a nozzle pivotally mounted in the housing; and a plurality of gears between the nozzle and the propeller shaft, the plurality of gears to pivot the nozzle to redirect the air flow out from the hand held hair dryer in response to rotation of the propeller.

2. The hand held hair dryer of claim 1, wherein the housing, the propeller, the nozzle, and the plurality of gears are integrated together as an attachment.

3. The hand held hair dryer of claim 2, wherein the hand held hair dryer is a standard hair dryer and the attachment is a universal attachment, and the hand held hair dryer further comprises:

a flexible boot coupled to the housing at one end, the flexible boot to flexibly couple to a body of the standard hair dryer.

4. The hand held hair dryer of claim 1, further comprising:

an electric heater between the fan and the propeller, the electric heater to heat the air flow in the housing.

5. The hand held hair dryer of claim 1, wherein the housing is rotatable to rotate a plane of the air flow.

6. The hand held hair dryer of claim 1, wherein the air flow is redirected out from the hand held hair dryer without restriction.

7. The hand held hair dryer of claim 1, wherein gear reduction provided by the plurality of gears pivots the nozzle back and forth in a plane.

8. The hand held hair dryer of claim 1, further comprising:

a pivot shaft coupled to the nozzle;

a linkage arm having a first end rotatably coupled to a crank gear of the plurality of gears, the linkage arm to convert rotational motion of the crank gear into linear motion of the linkage arm; and a drive arm having a first end rotatably coupled to a second end of the linkage arm and a second end affixed to the pivot shaft, the drive arm to convert linear motion of the linkage arm into pivotal motion of the pivot shaft and the nozzle.

9. The hand held hair dryer of claim 8, wherein the housing includes a retaining collar having a pair of bushings, the pivot shaft having ends pivotally coupled to the pair of bushings.

10. The hand held hair dryer of claim 8, wherein the housing includes an intake sleeve having a first opening at a first end to receive the air flow and a second opening at a second end to direct the air flow into the nozzle, the propeller supported within the intake sleeve aligned with the intake opening to receive the air flow.

11. A hair dryer attachment comprising:

a housing with a first opening to couple to an end of a hair dryer;

a propeller aligned with the first opening of the housing to receive air flow from the end of the hair dryer, the propeller coupled to a propeller shaft;

a nozzle pivotally mounted in the housing; and a gear stack coupled between the nozzle and the propeller shaft, the gear stack to pivot the nozzle in response to rotation of the propeller.

12. The hair dryer attachment of claim 11, further comprising:

a pivot shaft coupled to the nozzle, the pivot shaft pivotally coupled to the housing, a linkage arm rotatably coupled to a final gear of the gearing at a first end, a drive arm having one end coupled to the pivot shaft and another end rotatably coupled to a second end of the linkage arm, wherein the linkage arm translates rotational motion of the final gear into linear motion, and wherein the drive arm translates the linear motion of the linkage arm into pivotal motion of the pivot shaft and the nozzle coupled thereto.

13. The hair dryer attachment of claim 11, wherein the gear stack repeatedly pivots the nozzle back and forth so that it automatically oscillates the air flow over a users head.

14. The hair dryer attachment of claim 11, further comprising:

a flexible boot coupled to the housing at one end, the flexible boot having a second end to flexibly couple to a body of the standard hair dryer.

15. The hair dryer attachment of claim 14, wherein the hair dryer attachment is a universal hair dryer attachment to couple to a plurality of models of hand held electric hair dryers.

16. A method of automatic air flow movement for a hand held hair dryer, the method comprising:

generating an air flow within a housing of a hand held hair dryer using a motorized fan;

directing the air flow within the housing of the hand held hair dryer at a propeller to rotate the propeller and a propeller shaft coupled to the propeller;

further directing the air flow within the housing of the hand held hair dryer into a nozzle;

converting rotational motion of the propeller shaft into a repetitive pivotal motion of the nozzle; and oscillating the air flow out from the nozzle by repetitively pivoting the nozzle in response to the rotational motion of the propeller shaft.

17. The method of claim 16, wherein the converting of rotational motion of the propeller shaft into the repetitive pivotal motion of the nozzle includes gearing down the rotational motion of the propeller shaft;

converting the rotational motion into a repetitive linear motion; and converting the repetitive linear motion into the repetitive pivotal motion.

18. The method of claim 16, further comprises:

heating the air flow with an electric heater prior to directing the air flow at a propeller.

19. The method of claim 16, further comprises:

rotating the nozzle to a different position to oscillate the air flow in a different plane than a first plane of air flow oscillation.

20. The method of claim 16, wherein a pivot shaft is coupled to the nozzle.

21. A nozzle attachment for a hair dryer comprising:

an oscillating nozzle to redirect air flow received from the hair dryer;

a collar to pivotally support the oscillating nozzle, the oscillating nozzle pivotally mounted to the collar in an opening thereof;

a hollow flexible rubber boot having a first opening at a first end to couple to a barrel of the hair dryer and a second opening at a second end to couple to the collar;

a bracket coupled to the collar;

a propeller aligned in the center of the first opening of the boot, the propeller coupled to a propeller shaft supported by the bracket; and a gear stack supported by the bracket, the gear stack between the oscillating nozzle and the propeller shaft to convert a rotational motion in the propeller shaft into a pivotal motion of the oscillating nozzle.

22. The nozzle attachment of claim 21, wherein the oscillating nozzle is a hollow spherical shape with openings at opposite sides.

23. The nozzle attachment of claim 21, wherein the oscillating nozzle is a hollow cylindrical shape with openings at opposite sides.

24. The nozzle attachment of claim 21, wherein the oscillating nozzle has a pivot shaft parallel with a center line, the pivot shaft having ends protruding from the oscillating nozzle to pivotally couple into bushings of the collar.

25. The nozzle attachment of claim 21, wherein the nozzle attachment is coupled to the hair dryer, and the oscillating nozzle automatically swivels in response to air flow being generated by the hair dryer.

26. The nozzle attachment of claim 21, wherein the gear stack includes a plurality of gears between the oscillating nozzle and the propeller shaft to convert the rotational motion of the propeller shaft into the pivotal motion of the oscillating nozzle.

27. The nozzle attachment of claim 26, wherein the gear stack further includes a linkage arm coupled to one of the plurality of gears to convert the rotational motion of the propeller shaft into a linear motion, and a drive arm coupled between the linkage arm and the oscillating nozzle to convert the linear motion into the pivotal motion of the oscillating nozzle.

* * * * *